US005650692A

United States Patent [19]

Vetanen et al.

[11] Patent Number: 5,650,692

[45] Date of Patent: Jul. 22, 1997

[54] ELECTROLUMINESCENT DEVICE CONSTRUCTION EMPLOYING POLYMER DERIVATIVE COATING

[75] Inventors: William Arno Vetanen, Dundee; Martin J. Aguilera, Beaverton, both of Oreg.

[73] Assignee: Planar Systems, Inc., Beaverton, Oreg.

[21] Appl. No.: 584,682

[22] Filed: Jan. 11, 1996

[51] Int. Cl.[6] ..... H01J 1/70; H01J 1/62

[52] U.S. Cl. ..... 313/506; 313/503; 313/511; 313/512; 315/169.3

[58] Field of Search ..... 313/503, 506, 313/509, 512, 511; 315/169.3; 204/192.26; 257/64.2

[56] References Cited

U.S. PATENT DOCUMENTS 4,767,679 8/1988 Kawachi ..... 313/503

5,072,152 12/1991 Tuenge et al. ..... 313/509

5,463,279 10/1995 Khormaei ..... 313/509

*Primary Examiner*—Sandra L. O'Shea

*Assistant Examiner*—Joseph Williams

*Attorney, Agent, or Firm*—Chernoff, Vilhauer, McClung & Stenzel

[57] ABSTRACT

A construction for electroluminescent device includes a substrate and an electroluminescent stack which forms a step relative to the substrate. A transparent layer of protective material is placed atop the stack to bridge the step and create a smooth edge profile along the edge. A metallization layer is situated atop the layer of protective material and is coupled to the electroluminescent stack through vias in the protective material.

5 Claims, 1 Drawing Sheet

ELECTROLUMINESCENT DEVICE CONSTRUCTION EMPLOYING POLYMER DERIVATIVE COATING

BACKGROUND OF THE INVENTION

The following invention relates to a construction for a thin-film electroluminescent device, and particularly, to a transparent coating for a thin-film electroluminescent stack that protects the stack from the effects of moisture and electrical breakdown and helps to prevent burnout in the metallization layer.

A major cause of failure in thin-film electroluminescent devices is phosphor burnout. Burnout may result from contamination of the thin-film electro-luminescent stack which contamination may cause front and rear electrode elements to short circuit creating a burnout that can render a portion of the display inoperative. Burnouts may also be caused by excessive current flowing through the top electrode layer which is usually fabricated from transparent indium tin oxide (ITO). Sometimes excessively high current flow in the ITO layer can be caused by poor aluminum step coverage over the ITO/phosphor stack combination.

The etching process for creating a patterned phosphor layer frequently causes the edges of the phosphor stack to be jagged and uneven, particularly in AMEL displays which are fabricated on a silicon substrate. In such displays a metalization layer which is a thin film of aluminum is deposited on the silicon substrate so as to bridge the step from the substrate to the top ITO layer. Thus the top ITO layer becomes a single wide area scanning electrode. Jagged areas of the phosphor layer can cause uneven deposition of the aluminum layer which can in turn lead to high resistance areas or even breaks in the aluminum layer. This in turn can cause a high current flow in such areas leading to burnout. Burnout can not only melt the aluminum but can lead to destruction of the panel's underlying circuitry.

The same problem exists when the TFEL device is in the form of a passive matrix device which employs a parallel set of elongate scanning electrodes. These electrodes are coupled to driver electronics devices by metal wires or straps which must bridge the step from the substrate up to the electrode surface. A jagged phosphor edge could puncture or sever one or more of the bond wires or straps.

SUMMARY OF THE INVENTION

The above-noted problems are solved by the instant invention which provides a construction for a thin-film electroluminescent device which includes a substrate and a thin-film electroluminescent stack including a top transparent electrode layer in which the stack forms a step along an edge thereof relative to the substrate. Typically, the stack is square or rectangular and all four edges form a step relative to the substrate. A transparent layer of protective material is deposited atop the thin-film electroluminescent stack and along a portion of the substrate so as to bridge the step and create a smooth edge profile along the edges of the electroluminescent stack. A metallization layer is placed atop the layer of protective material and is coupled to the transparent electrode layer through vias or apertures in the layer of protective material.

The layer of protective material may be derived from a polymer resin. One such material is sold by the Dow Chemical Company under the trade name CYCLOTENE. CYCLOTENE is an electronic resin derived from b-staged bisbenzocyclobutene (BCB monomers). The resin employed should have high capacitance, high resistivity and should planarize upon application. The preferred method of application is a spin coating, but spraying and other types of application are also possible.

The electroluminescent device may be masked prior to deposit of the protective resin material so that lift off of the masked portions may provide vias for attachment of the metallization layer to the transparent layer.

DETAILED DESCRIPTION OF THE PREFERRED EMBODIMENT

Figure 1:
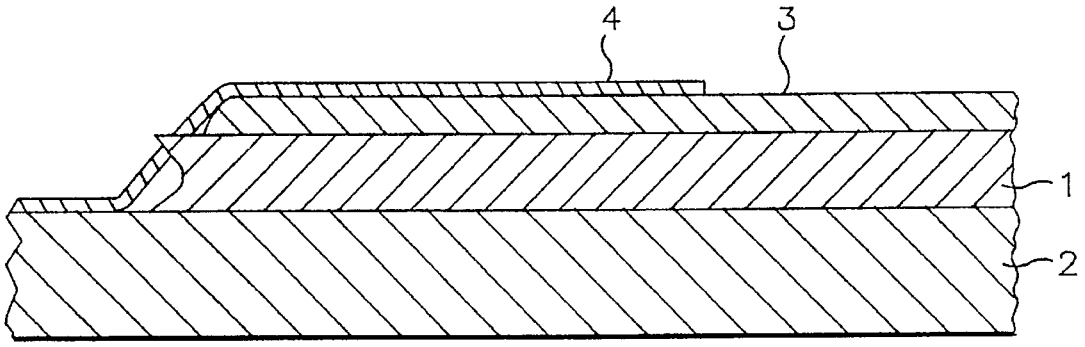
FIG.1 (PRIOR ART)
FIG. 1 is a partial side cutaway view of a TFEL stack exemplary of prior art constructions of such devices.

In prior devices such as that shown in FIG. 1 a thin film electroluminescent phosphor stack 1 is placed on a substrate 2 such as silicon or the like. Overlaying the phosphor stack 1 is a transparent electrode layer 3. A metallization layer 4 extends from the substrate 2 to the top of the transparent electrode layer 3. Because the edge of the EL stack 1 may be jagged, the metallization layer 4 is in danger of being punctured as is shown in FIG. 1.

Figure 2:
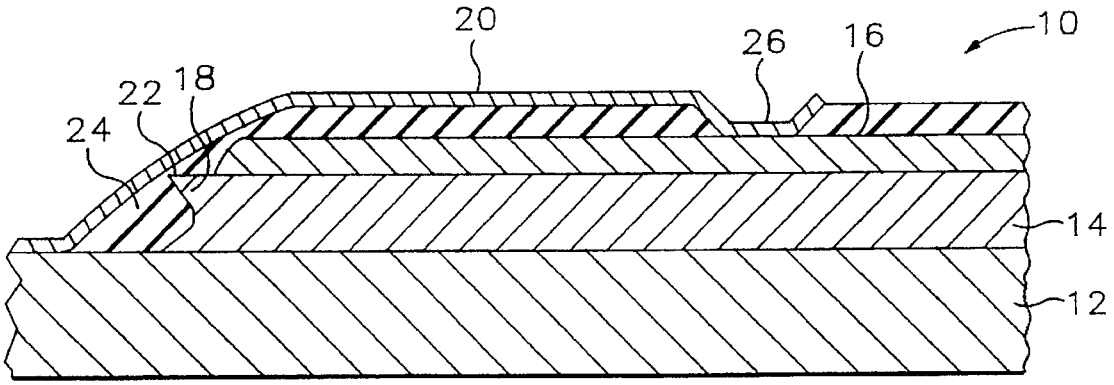
FIG. 2 is a partial side cutaway view of a TFEL device employing the protective coating of the present invention.

Referring to FIG. 2 an AMEL device 10 includes a silicon substrate 12. A thin film phosphor stack is deposited atop the silicon substrate 12. The phosphor stack may include an electrode layer comprising pixel electrodes, one or more insulators and one or more thin film phosphor layers. A typical structure for such a device is shown in U.S. Pat. No. 5,463,279 entitled ACTIVE MATRIX ELECTROLUMINESCENT CELL DESIGN which is assigned to Planar Systems, Inc., the assignee herein. A transparent electrode layer 16 overlays the TFEL stack. The transparent electrode layer may be fabricated from indium tin oxide (ITO) or any other transparent conductive material. In the AMEL device of the preferred embodiment the top transparent electrode 16 is a sheet of such material. In passive TFEL devices this layer would comprise a set of parallel electrode strips.

Figure 3:
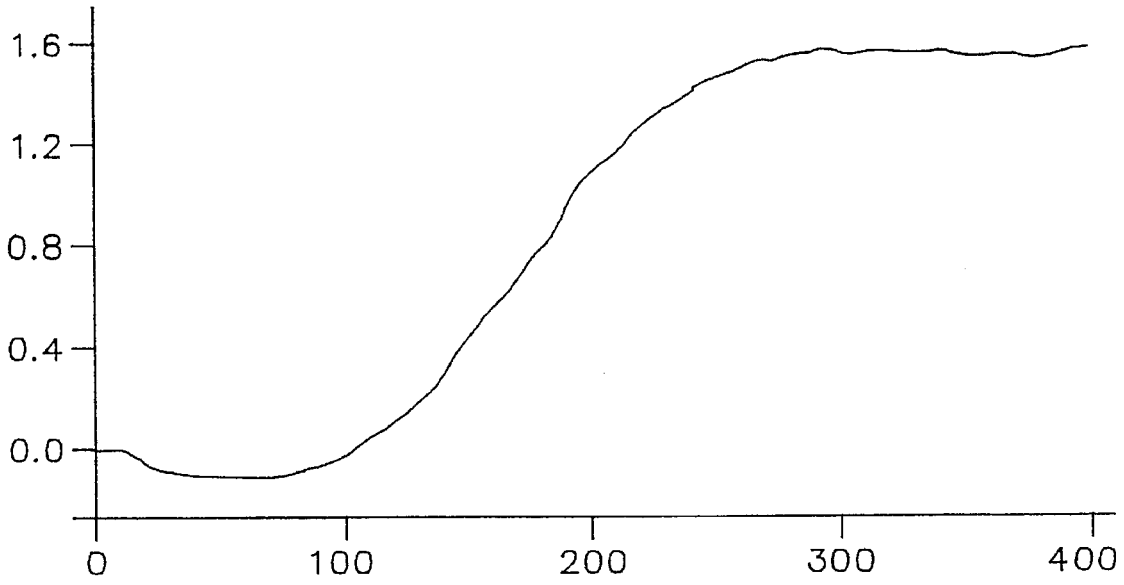
FIG. 3 is a graph representing a physical profile made with a profilometer of a TFEL device employing the protective coating of the invention along the outer edge of the TFEL stack.

The transparent electrode layer together with the TFEL stack 14 form a step generally designated at 18 in the vertical direction with respect to the substrate 12. A metallization layer 20 bridges the step along the edge 22 of the stack of materials comprising the TFEL stack 14 and the transparent electrode layer 16. A polymer derivative 24 is applied to the top of the transparent electrode layer 16 and is permitted to flow over the edge 22 to the substrate 12. This polymer fills in the areas created by the jagged edge 22 of the TFEL stack 14 and the transparent electrode layer 16. When the polymer cures it encapsulates the uneven edge structure by planarizing in the area of the step between the top of the substrate 12 and the top of the transparent electrode layer 16. As FIG. 3 shows this creates an edge profile that is smooth so that when the metallization layer 20 is connected to the transparent electrode layer 16 so as to bridge the step, there are no sharp protrusions exposed along the edge 22 that could contact or puncture the metallization layer 20.

The protective material is a transparent electronics resin which, when applied, is a high solidlow viscosity solution. Upon curing the coating provides planarization both along the top of the transparent electrode layer and in the area of the edge 22. Preferably the resin is derived from B staged bisbenzocyclobutene (BCB) monomers. An example of such a resin is sold under the trade name CYCLOTENE, manufactured by Dow Chemical Company. Any such electronic resin that is employed for this purpose, however, should have a high dielectric constant, high moisture resistance and high resistance to electrical breakdown.

If desired, the protective coating 24 may be extended all the way across the top of the transparent electrode layer 16 to fully encapsulate the TFEL stack and its associated transparent electrode layer. This provides enhanced moisture resistance for the TFEL stack 14 which is desirable because moisture is a leading cause of electrical breakdown.

The preferred method of applying the protective material 24 is by spin coating although spraying and other methods of deposition may also be employed.

Where the protective material is to be used to coat the entire upper surface of the device 10, a mask may be employed during the deposition process so that vias 26 are provided in the protective coating 24 to enable the metallization layer 20 to be electrically connected to the transparent electrode layer 16.

What is claimed is:

1. A construction for an electroluminescent device comprising:

(a) a substrate;

(b) an electroluminescent stack including a top transparent electrode layer and an electroluminescent phosphor layer, the stack forming a step along an edge thereof relative to the substrate;

(c) a transparent layer of protective material deposited atop at least a portion of the electroluminescent stack and along a portion of the substrate so as to bridge the step and create a smooth edge profile along said edge; and (d) a metal film layer deposited from the substrate along the smooth edge profile of the protective material to the top transparent electrode layer and electrically coupled to said top transparent electrode layer.

2. The construction of claim 1 wherein the layer of protective material is formed from a resin.

3. The construction of claim 2 wherein the resin is a BCB monomer resin.

4. A method of constructing an electroluminescent device comprising the steps of:

(a) forming an electroluminescent stack including a bottom electrode layer, one or more insulator layers, a thin-film phosphor layer and a top transparent electrode layer onto a substrate, the stack forming a step along an edge thereof relative to the substrate;

(b) coating the electroluminescent stack with a liquid containing a curable resin so that the material flows across said edge and onto the substrate;

(c) curing the protective resin material so as to bridge the step between the substrate and the electroluminescent stack to create a smooth edge profile; and (d) forming a metallization film layer atop the cured resin layer and electrically coupling said metallization layer to said top transparent electrode layer.

5. The method of claim 4 wherein a mask is used during the application of said resin material and during said curing step, the mask providing vias for said metallization layer.

* * * * *